United States Patent [19]

Kishino et al.

[11] 4,047,072

[45] Sept. 6, 1977

[54] MULTI-DIGIT FLUORESCENT DISPLAY TUBE

[75] Inventors: Takao Kishino; Kiyoshi Morimoto; Yukihiko Utamura, all of Mobara, Japan

[73] Assignee: Futaba Denshi Kogyo Kabushiki Kaisha, Japan

[21] Appl. No.: 671,150

[22] Filed: Mar. 29, 1975

[30] Foreign Application Priority Data

Mar. 28, 1975 Japan ..... 50-36848
May 16, 1975 Japan ..... 50-57457

[51] Int. Cl.[2] ..... H01J 61/067; H01J 61/66

[52] U.S. Cl. ..... 313/496; 313/519; 313/220; 313/313

[58] Field of Search ..... 313/496, 517, 518, 519, 313/220, 497, 313

[56] References Cited

U.S. PATENT DOCUMENTS 3,571,655 3/1971 Manimoto ..... 313/497 X
3,705,324 12/1972 Masuda ..... 313/517

FOREIGN PATENT DOCUMENTS 2,107,604 8/1971 Germany ..... 313/519

*Primary Examiner*—Palmer C. Demeo
*Attorney, Agent, or Firm*—Oblon, Fisher, Spivak, McClelland & Maier

[57] ABSTRACT

A multi-column fluorescent display tube having a casing composed of a base plate and a cover plate, multi-column pattern display sections each composed of a plurality of segment anodes with fluorescent material layers thereon provided on the upper surface of the base plate, cathodes provided opposite to the pattern display sections, electrification preventive layers provided around and in the vicinity of the segment anodes on the base plate and electrically connected to prevent electrification and to intercept an external electric field, and terminal lead-in wires provided outside the casing and air-tightly connected through the casing to the respective segment anodes, cathodes and electrification preventive layers.

7 Claims, 15 Drawing Figures

MULTI-DIGIT FLUORESCENT DISPLAY TUBE

BACKGROUND OF THE INVENTION

1. Field of the Invention

The present invention relates to a multi-column fluorescent display tube (hereinafter referred to as a fluorescent display tube) suitable for use in small-sized electronic equipment such as an electronic clock of a digital display type.

2. Description of the Prior Art

Generally, a fluorescent display tube has fluorescent material coated elements which emit light when electrons emitted from a cathode come into collision therewith, and therefore can obtain a very clear display. For this reason, the fluorescent display tube is widely used for small-sized electronic desk calculators and various digital-display electronic apparatus. In addition, a drive circuit according to a dynamic drive system is generally provided for actuating the fluorescent display tube. In such a drive circuit, provision of only one decoder is sufficient for forming input signals to be applied to segment anodes of each of multi-column pattern display sections so that the segments anodes may selectively display a desired pattern such as a figure; in short, only one decoder is sufficient for actuating the multi-column pattern display sections. Therefore, the circuit can be made simple in constitution, and the number of large scale integrations (LSI) incorporated in the circuit and that of lead-in terminal wires of the fluorescent display tube can be decreased. Thus the circuit of this kind is widely used for multi-column electronic desk calculators. The fluorescent display tube used in combination with a drive circuit of a dynamic drive system usually carries out the switching of column selection by a control electrode, and therefore it is in the form of a triode provided with a mesh-shaped control electrode. However, the above-mentioned drive circuit according to a dynamic drive system has disadvantages in that, when it actuates the fluorescent display tube, pulse current flows in the fluorescent display tube and the circuit to thereby cause noises, and therefore it can not be applied to the display of an electronic clock or the like incorporated in an acoustic or image-displaying electronic equipment such as a clock radio which must avoid access to noise sources.

Accordingly, a fluorescent display tube to be incorporated in an acoustic or image-displaying electronic equipment which must avoid access to noise sources should be preferably made so that it can be used in cooperation with a drive circuit according to a so-called static drive system which has no pulse power source acting as a noise source. In the case of a drive circuit according to the static drive system, current is made to flow between the segment electrodes and the cathodes corresponding to a column selected according to a pattern such as a figure to be fluorescently displayed, and therefore, a control electrode for column selection is not necessary. Accordingly, a fluorescent display tube for use with this circuit is in the form of a diode. In the case of the fluorescent display tube in the form of a diode, the upper surface of a base plate around segment anodes tends to be unevenly electrified due to electrons and the like emitted from the cathode. In addition, when the upper surface of the base plate is electrified, the electric field and electron current in a space between the cathodes and the segment anodes where electrons emitted from the cathodes are passed through becomes disturbed resulting in an uneven luminescence of the fluorescent material layer mounted on each segment anode and, what is worse, the fluorescent material layer on a segment anode which is desired to luminesce becomes unable to emit light. Furthermore, an external electric field changes the electrification conditions around the segment anodes and thereby exerts an influence on the electron current flowing between the cathode and the anodes with the consequent result that a normal luminescence of the fluorescent material layer can not be achieved. For the reasons mentioned above, a fluorescent display tube incorporated in a drive circuit according to a static drive system has been heretofore provided with a mesh-shaped control electrode between the cathode and a group of anodes so that the electron current flowing between the cathode and the anodes may not be influenced by the electrification conditions and external electric field as mentioned above.

SUMMARY OF THE INVENTION

Therefore, the present invention contemplates the elimination of the above-mentioned disadvantages of the prior art and the provision of a novel fluorescent display tube in the form of a diode suitable for use with a drive circuit according to a so-called static drive system.

It is an object of the present invention to provide a fluorescent display tube which can achieve a very clear and uniform fluorescent display.

It is another object of the present invention to provide a fluorescent display tube which is simple in construction, high in quality, easy and inexpensive to manufacture, and small in power consumption.

It is still another object of the present invention to provide a fluorescent display tube which is adaptable for use in a drive circuit according to a static drive system.

It is a further object of the present invention to provide a fluorescent display tube which is not subjected to an external electric field.

According to the present invention, there is provided an improved fluorescent display tube having a casing consisting of a base plate and a cover plate sealingly joined to each other, multicolumn pattern display sections each consisting of a plurality of segment anodes adapted to display patterns such as characters, figures and symbols, and cathodes provided opposite to the pattern display sections; which comprises an electrification preventive layer provided around and in the vicinity of each segment anode on the base plate and electrically connected so as to prevent electrification and to intercept an external electric field, and terminal lead-in wires provided outside the casing and connected at least to the electrification preventive layers and each of a plurality of the segment anodes and the cathodes, respectively.

BRIEF DESCRIPTION OF THE DRAWINGS

Other objects, features and advantages will be more apparent from the following description in conjunction with the accompanying drawings in which like reference characters designate corresponding parts throughout the views and in which.

DETAILED DESCRIPTION OF THE PREFERRED EMBODIMENTS

Figure 1:
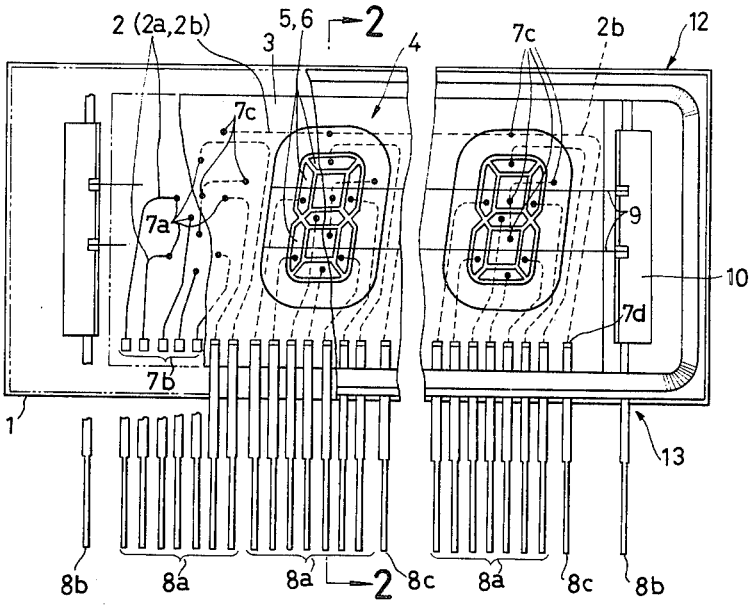
FIG. 1 is a partially cutaway plan view of the essential part of a multi-column fluorescent display tube according to the first embodiment of the present invention.
Figure 2:
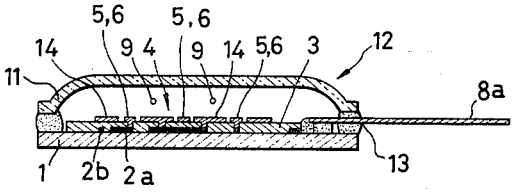
FIG. 2 is a sectional view taken along the line 2—2 of FIG. 1.

Reference is now made to the drawings, especially to FIGS. 1 and 2.

Reference numeral 1 designates a base plate made of an insulating material such as glass or ceramic. A plurality of wiring films 2 (2*a* and 2*b*) and an insulating film 3 are coated on the upper surface of the base plate 1 in a laminated manner. In addition, on the upper surface of the insulating film 3, there is provided multi-column pattern display sections 4. Each of the multi-column pattern display sections is composed of a plurality of segment anodes 5 so that it can selectively display patterns such as characters, figures and symbols. Each segment anode 5 is provided with a fluorescent material layer 6 thereon.

Each of terminal lead-in wires 8*a* for a segment anode is electrically connected to each corresponding segment anode 5 by each corresponding wiring film 2*a* through each of a plurality of connections 7*a* and 7*b* provided in the openings of the insulating film 3. Numeral 9 designates one or a plurality of cathodes provided opposite to the pattern display sections 4. The cathode 9 is usually composed of a filament-shaped fine wire made of a high melting-point metal such as tungsten and a coating material layer having a high thermionic emission efficiency coated on the fine wire. The cathode 9 is connected to terminal lead-in wires 8*b* through filament supports 10 which support the cathode 9. Numeral 11 designates a cover plate made of an insulating material. The cover plate 11 has a transparent peep window portion made of an insulating material such as glass and covering at least the area to be placed opposite to the pattern display sections 4. The base plate 1 and the cover plate 11 are air-tightly joined together at the peripheral portions thereof by a sealing material such as low melting point frit glass to thereby form a casing 12. The terminal lead-in wires 8*a* and 8*b* are air-tightly sealed in and passed through a seal portion 13 between the base plate 1 and the cover plate 11 so that electric current can be supplied from the outside. The inside surface of the cover plate 11 is coated with a transparent conductive film called "nesa film" electrically connected to the cathode 9.

A plurality of electrification preventive layers 14 made up of conductive or high-resistance material films, which are adapted to prevent electrification due to collision of electrons emitted from the cathode 9, are provided on the upper surface of the insulating film 3 in the vicinity of and flush with each segment anode 5. The respective electrification preventive layers 14 are electrically connected together by the wiring films 2*b* through a plurality of connections 7*c* and 7*d* provided in openings of the insulating film 3, and are connected to terminal lead-in wires 8*c* which are air-tightly penetrated through the seal portion 13.

In FIG. 1, the electrification preventive layers 14 are shown as provided separately, one for each pattern display section 4. However, since these layers 14 are electrically connected together eventually, a single electrification preventive layer 14 integrally connected may be provided instead of a plurality of separate layers.

The fluorescent display tube as mentioned above may be operated by a so-called static drive system which gives the electrification preventive layers 14 a bias voltage higher than at least that of the cathode, preferably, a positive (+) bias voltage ranging from about the average of the cathode voltage and anode voltage to the anode voltage, and applies a DC voltage across the cathode 9 and a plurality of segment anodes 5 selected according to patterns such as characters and figures intended for display. Thus, a desired fluorescent display can be obtained. Furthermore, the fluorescent display tube according to the present invention is in the form of a diode which is not provided with such a mesh-shaped control electrode as incorporated in most of the conventional fluorescent display tubes, and therefore can obtain a very bright and clear fluorescent display. Besides, the fluorescent display tube according to the present invention is provided with the electrification preventive layers 14 around a plurality of segment anodes on the base plate 1, to which a voltage equal to or slightly higher than that of the anodes 5 is applied; and therefore electrification due to electrons does not take place around the segment anodes 5 during operation and, accordingly, electron current is not disturbed with the consequent result that a very clear fluorescent display without any unevenness or eclipse is obtained. In addition, the fluorescent display tube according to the present invention is operated on DC according to the static drive system, and therefore does not produce any noise sources for an electronic equipment such as a radio and, as a result, can be incorporated in equipment which must avoid access to any noise sources.

Figure 3:
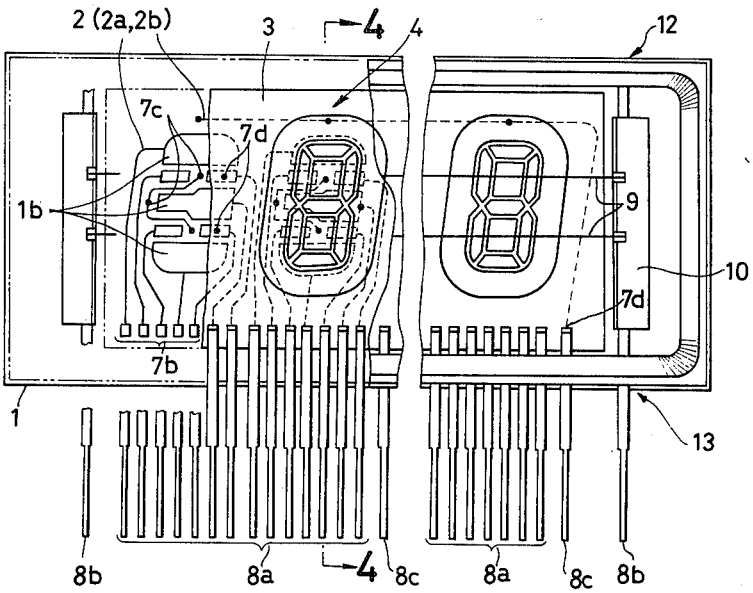
FIG. 3 is a partially cutaway plan view of the essential part of a multi-column fluorescent display tube according to the second embodiment of the present invention.
Figure 4:
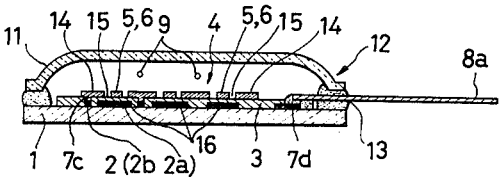
FIG. 4 is a sectional view taken along the line 4—4 of FIG. 3.

Reference is now made to FIGS. 3 and 4 which show the second embodiment of the present invention.

The fluorescent display tube shown in FIGS. 3 and 4 according to the second embodiment of the present invention is constructed on the basis of the same principle as the fluorescent display tube according to the first embodiment of the present invention shown in FIGS. 1 and 2. In other words, it is provided with a plurality of electrification preventive layers 14 which are positioned in the vicinity of and flush with each segment anode 5 on the insulating film 3 and are adapted to prevent electrification due to collision of electrons emitted from the cathode 9 and are connected to the terminal lead-in wires 8*c* through the wiring films 2*b*.

The fluorescent display tube according to the second embodiment of the present invention shown in FIGS. 3 and 4 is further provided with a plurality of conductive shielding films 16 for preventing influence of an electric field from under the base plate 1 on gaps 15 between the segment anodes 5 and the electrification preventive layers 14, which shielding films 16 are the expanded portions of the wiring films 2*a* at the ends thereof and are disposed on the upper surface of the base plate 1 opposite to the segment anodes 5 with the insulating film 3 therebetween and, in addition, are connected to the terminal lead-in wires 8*a* through the wiring fims 2*a*.

In the case of the first embodiment of the present invention shown in FIGS. 1 and 2, there are possibilities that electron current emitted from the cathode 9 will be disturbed due to a strong electric field in the vicinity of the bottom surface of the base plate 1 through the gaps 15 between the segment anodes 5 and the electrification preventive layers 14, and thereby a normal fluorescent display may not be obtained. On the other hand, the fluorescent display tube according to the second embodiment of the present invention shown in FIGS. 3 and 4 is not influenced by an electric field from under the bottom surface of the base plate 1 because of a plurality of shielding films 16 in addition to the electrification preventive layers 14, and therefore can obtain a clear and stable fluorescent display.

Figure 5:
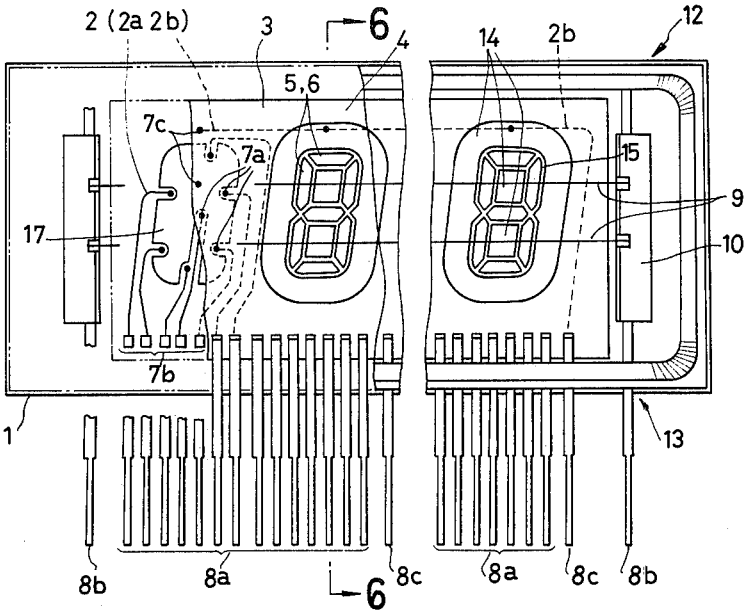
FIG. 5 is a partially cutaway plan view of the essential part of a multi-column fluorescent display tube according to the third embodiment of the present invention.
Figure 6:
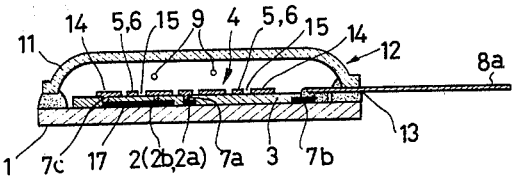
FIG. 6 is a sectional view taken along the line 6—6 of FIG. 5.

Reference is now made to FIGS. 5 and 6 which show the third embodiment of the present invention.

The fluorescent display tube according to the third embodiment of the present invention is constructed on the basis of the same fundamental principle as the fluorescent display tube according to the first embodiment shown in FIGS. 1 and 2. In other words, it is provided with a plurality of electrification preventive layers 14 which are positioned on the upper surface of the insulating film 3 and in the vicinity of and flush with each segment electrode 5 and which prevent electrification due to collision of electrons emitted from the cathode 9 and are connected to the terminal lead-in wires 8*c* through the wiring films 2*b*.

The fluorescent display tube according to the third embodiment of the present invention shown in FIGS. 5 and 6 is further provided with conductive shielding films 17 for preventing the influence of an electric field from under the base plate 1 on the gaps 15 between the segment anodes 5 and the electrification preventive layers 14, which shielding films 17 are the expanded portions of the ends of the wiring films 2*b* for electrification preventive layers 14 and are disposed on the upper surface of the base plate 1 opposite to the segment anodes 5 with the insulating film 3 therebetween and are connected to the terminal lead-in wires 8*c* through the wiring films 2*b* for the electrification preventive layers 14.

Thus the fluorescent display tube according to the third embodiment of the present invention is also not influenced by an electric field from under the bottom surface of the base plate 1 because of the shielding films 17 in the same manner as in the case of the second embodiment, and therefore can obtain a very clear and stable fluorescent display.

Figure 7:
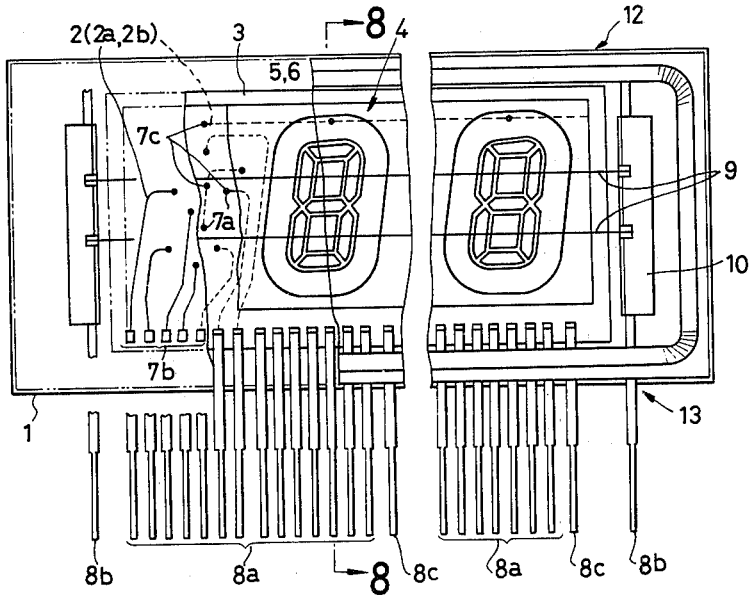
FIG. 7 is a partially cutaway plan view of the essential part of a multi-column fluorescent display tube according to the fourth embodiment of the present invention.
Figure 8:
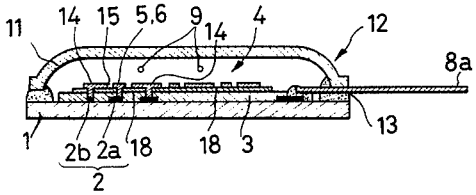
FIG. 8 is a sectional view taken along the line 8—8 of FIG. 7.

Reference is now made to FIGS. 7 and 8 which show the fourth embodiment of the present invention.

The fluorescent display tube according to the fourth embodiment of the present invention is further provided with high-resistance films 18 on the upper surface of the insulating film 3 for giving a high resistance of about 1 MΩ to 100,000 MΩ, preferably 10 MΩ to 1,000 MΩ to the areas between the segment anodes 5 and electrification preventive layers 14 which are coated on the upper surface thereof. The high-resistance film 18 coated on the upper surface of the insulating film 3 may be a high-resistance film formed by using a mixture of low melting-point glass frit and fine powder of conductive or semiconductive material mixed in a suitable ratio, or may be a thin high-resistance film formed by vacuum evaporation of conductive or semiconductive material, or may be a transparent thin high-resistance film formed of a tin-oxide film called nesa film whose resistance is adjusted to a desired value. The high-resistance films 18 shield the electron current flowing from the cathode 9 to each segment anode 5 from an external electric field in the vicinity of the bottom surface of the base plate 1; and, in addition, the high-resistance films 18 prevent electrification of the gaps 15 between the segment anodes 5 and the electrification preventive layers 14 even when electrons come into collision with the gaps 15 because all the electrons coming into collision with the gaps 15 flow out into the segment anodes 5 or the electrification preventive layers 14 thereby eliminating disturbance of the electron current flowing from the cathode 9 to each segment anode 5 with the consequent result that a very clear fluorescent display can be obtained.

In the above-mentioned fourth embodiment of the present invention, the high-resistance films 18 are shown as provided on the insulating films 3 and between the insulating film 3 and the segment anodes 5 or between the insulating films 3 and the electrification preventive layers 14. However, the arrangement of the high-resistance films 18 is not limited to the above-mentioned. In other words, the high-resistance films 18 able to give a high resistance of about 1 MΩ to 100,000 MΩ, preferably 10 MΩ to 1,000 MΩ to the gaps 15 between the segment anodes 5 and the electrification preventive layers 14 may be provided on the upper surfaces of the segment anodes 5 and those of the electrification preventive layers 14 coated on the insulating film 3 or may be provided on the upper surface of the insulating film 3 at the gaps 15 between the segment anodes 5 and electrification preventive layers 14 coated on the insulating film 3.

Figure 9:
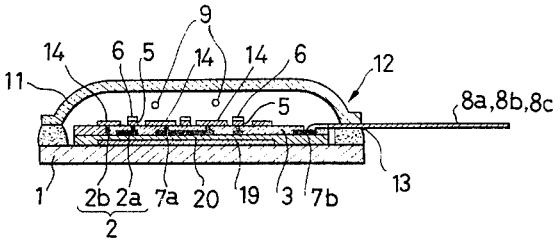
FIG. 9 is a sectional view similar to FIG. 2 showing the fifth embodiment of the present invention.

Reference is now made to FIG. 9 showing the fifth embodiment of the present invention.

The fluorescent display tube according to the fifth embodiment of the present invention is provided with first conductive shielding films 19 having enough areas for shielding at least a plurality of gaps 15 between the segment anodes 5 and the electrification preventive layers 14 from an external strong electric field in the vicinity of the bottom surface of the base plate 1, and first insulating layers 20 adapted to insulate the first shielding films 19 from a plurality of the wiring films 2, the first insulating layers 20 being coated on the upper surface of the base plate 1 and provided between the base plate 1 and the wiring films 2 in a laminated manner. The voltage applied to the first shielding films 19 may range from the voltage of the cathode 9 to that of the segment anodes 5.

As mentioned above, the fluorescent display tube according to the fifth embodiment of the present invention shown in FIG. 9 is provided with first shielding films 19 which are coated on the upper surface of the base plate 1 and are positioned under the wiring films 2 with the first insulating layers 20 therebetween so that they may shield at least the gaps 15 between the segment anodes 5 and the electrification preventive layers 14 from an external electric field in the vicinity of the bottom surface of the base plate 1, and therefore can obtain a very clear and stable fluorescent display not influenced by an external electric field from under the bottom surface of the base plate 1.

In the fluorescent display tube according to the fifth embodiment of the present invention mentioned above, the electrification preventive layers 14 disposed around and in the vicinity of each segment anode 5 on the base plate 1 are shown as provided substantially flush with the segment anodes 5. However, the arrangement of the electrification preventive layers 14 is not limited to the above-mentioned. For instance, as shown in FIG. 10 which illustrates the sixth embodiment of the present invention, the electrification preventive layers 14 may be provided so as not to be flush with the segment anodes 5.

Figure 10:
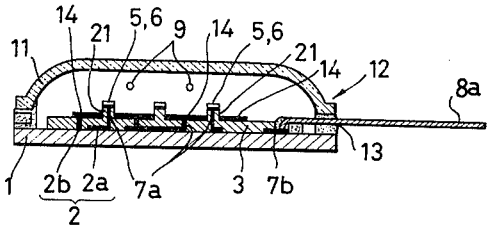
FIG. 10 is a sectional view similar to FIG. 2 showing the sixth embodiment of the present invention.

Reference is now made to FIG. 10 which shows the sixth embodiment of the present invention.

In this sixth embodiment, the wiring films 2 (2*a* and 2*b*), insulating film 3 and electrification preventive layers 14 are provided on the upper surface of the base plate 1 in a laminated manner, Insulating layers 21 are coated on the electrification preventive layers 14. Segment anodes 5 and fluorescent material layers 6 are provided on the insulating layers 21. Accordingly, each segment anode is insulated from the electrification preventive layers 14 by at least the insulating layers 21 having a high resistance of about several MΩ or more. In addition, the insulating layer 21 is connected to the insulating film 3 and is provided with openings at suitable positions for receiving connections 7*a* connecting the wiring films 2*a* and the segment anodes 5; and furthermore the insulating layer 21 on the upper surface of which the segment anode 5 is coated is at the upper surface thereof as wide as or slightly wider than the segment anode 5, and is as wide as the upper surface thereof or slightly narrower than the segment anode 5 at the portions thereof where it penetrates through the electrification preventive layer 14.

Thus, the fluorescent display tube according to the sixth embodiment of the present invention has substantially a very narrow gap between each segment anode 5 and electrification preventive layer 14 and is so constructed that an external electric field can not exert influence from under the bottom surface of the base plate 1, and therefore can obtain a very clear fluorescent display not influenced by an external electric field.

Figure 11:
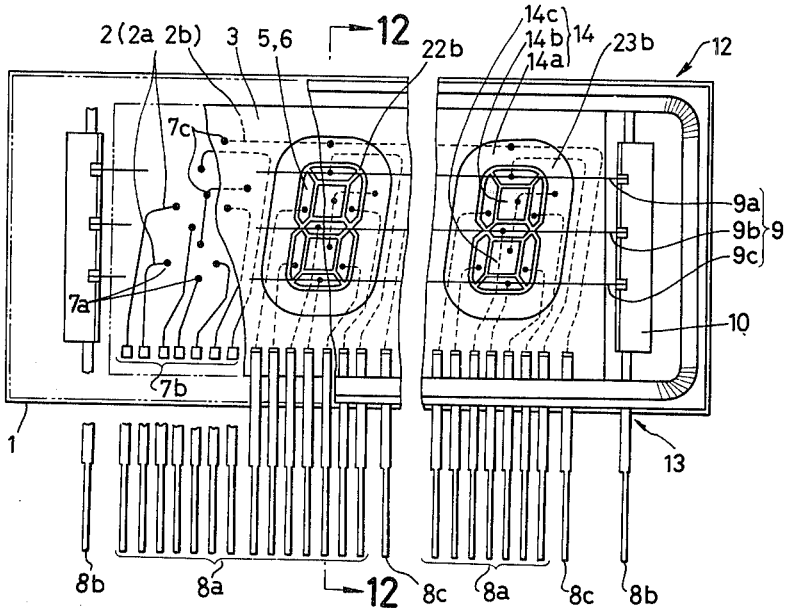
FIG. 11 is a partially cutaway plan view of the essential part of the seventh embodiment of the present invention.
Figure 12:
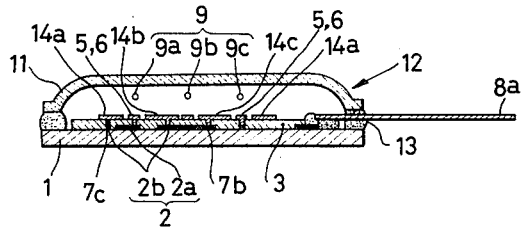
FIG. 12 is a sectional view taken along the line 12—12 of FIG. 11.
Figure 13:
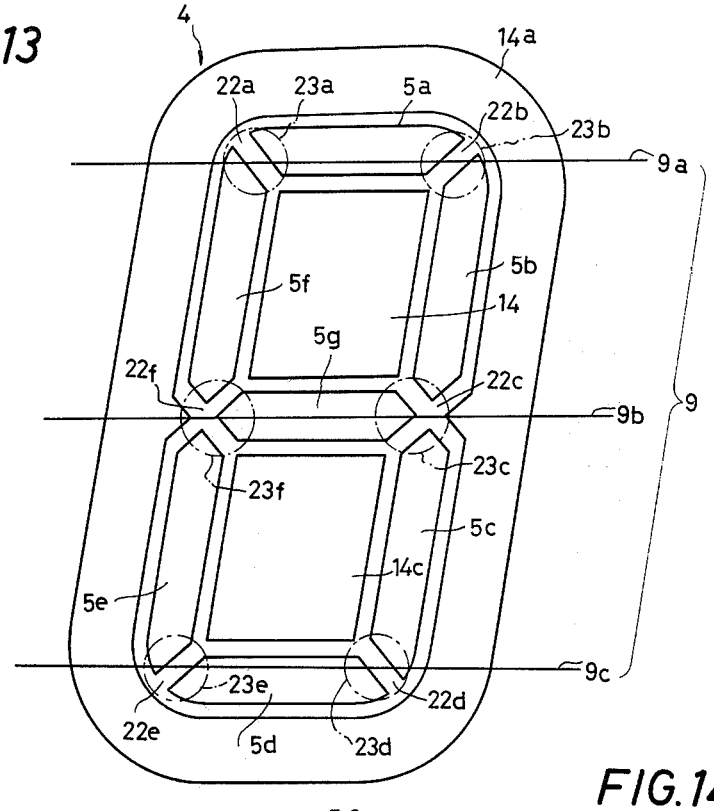
FIG. 13 is an enlarged schematical plan view of the pattern display section according to the seventh embodiment of the present invention shown in FIG. 11.

Reference is now made to FIGS. 11, 12 and 13 which show the seventh embodiment of the present invention.

In this embodiment, a plurality of cathodes 9 (the number of cathodes is shown as three in the drawings, i.e., 9*a*, 9*b* and 9*c*) are provided in parallel with one another and with the pattern display sections and opposite to the corresponding parts of the pattern display sections 4. The uppermost cathode 9*a* is provided so that it stretches over and commonly opposite a plurality of connections 23*a* and 23*b* where either end of the upper lateral segment anode 5*a* and each upper end of the upper longitudinal segment anodes 5*b* and 5*f* of each θ-shaped pattern display section 4 are positioned in the vicinity of each other with a gap portion 22*a* or 22*b* therebetween. The central cathode 9*b* is provided so that it stretches over and commonly opposite to a plurality of connections 23*c* and 23*f* where either end of the central lateral segment anode 5*g* and each central end of the right longitudinal segment anodes 5*b* and 5*c* and that of the left longitudinal segment anodes 5*e* and 5*f* of each θ-shaped pattern display section 4 are positioned in the vicinity of one another with a gap portion 23*c* or 23*f* therebetween. The lowermost cathode 9*c* is provided so that it stretches over and commonly opposite a plurality of connections 23*d* and 23*e* where either end of the lower lateral segment anode 5*d* and each lower end of the lower longitudinal segment anodes 5*c* and 5*e* of each θ-shaped pattern display section 4 are positioned in the vicinity of each other with a gap portion 22*d* or 22*e* therebetween. The cathodes 9 (9*a*, 9*b* and 9*c*) are connected to the terminal lead-in wires 8*b* for the cathode through the filament supports 10 which support the cathode 9.

The electrification preventive layer 14 shown in the drawings is divided into three layers 14*a*, 14*b* and 14*c*. The layer 14*a* is provides so that it surrounds the outside of the θ-shaped pattern display section, and layers 14*b* and 14*c* are provided so that they are surrounded by the θ-shaped pattern display section 4. These layers 14*a*, 14*b* and 14*c* are electrically connected to each other through the connections 7*c* by the wiring films 2*b* provided under the layers 14 with the insulating film 3 therebetween. However, the arrangement of the electrification preventive layers 14*a*, 14*b* and 14*c* is not limited to the above-mentioned. For instance, the electrification preventive layers 14*a*, 14*b* and 14*c* may be electrically connected to each other in the same plane by providing thin connection wires between the gap portions 22*a*, 22*b*, 22*c*, 22*d*, 22*e* and 22*f* of the respective segment anodes 5*a*, 5*b*, 5*c*, 5*d*, 5*e*, 5*f* and 5*g*.

As mentioned above, the fluorescent display tube according to the seventh embodiment of the present invention has a plurality of cathodes 9*a*, 9*b* and 9*c* provided so that they stretch over and opposite to the connections "23*a* and 23*b*", "23*c* and 23*f*" and "23*d* and 23*e*" formed by the respective segment anodes 5*a*, 5*b*, 5*c*, 5*d*, 5*e*, 5*f* and 5*g*, respectively. Thus the cathodes 9 are placed extremely near the ends of the respective segment anodes 5 where the electric fields of the respective segment anodes 5 tend to have influence on one another, and therefore the mutual influence between the end portions of the adjacent segment anodes can be eliminated with the consequent result that a very clear and bright fluorescent display can be obtained.

In addition, the fluorescent display tube according to the present invention is DC-operated by the static drive system, and therefore does not produce any noise sources for an electronic equipment such as radio with the consequent result that is can be incorporated in an electronic equipment which must avoid access to noise sources.

Figure 14:
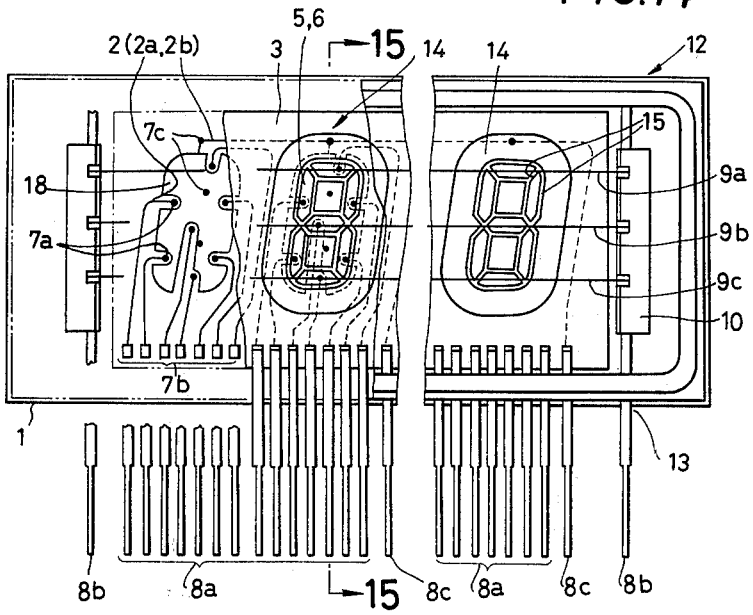
FIG. 14 is a partially cutaway plan view of the essential part of the eighth embodiment according to the present invention.
Figure 15:
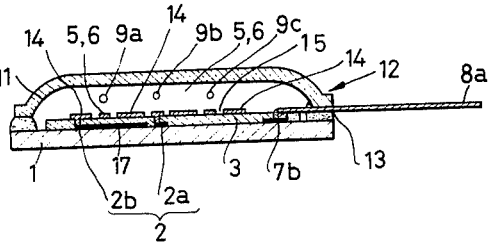
FIG. 15 is a sectional view taken along the line 15—15 of FIG. 14.

Reference is now made to FIGS. 14 and 15 which show the eighth embodiment of the present invention.

The fluorescent display tube according to the eighth embodiment of the present invention is constructed basically of the same conception as the seventh embodiment of the present invention shown in FIGS. 11, 12 and 13. In other words, it has a plurality of electrification preventive layers 14 which are provided around, in the vicinity of, and flush with each segment anode 5 on the upper surface of the insulating film 3 and prevent electrification caused by collision of electrons emitted from the cathodes 9 and are connected to the terminal lead-in wires 8*c* through the wiring films 2*b*, and has a plurality of cathodes 9 (9*a*, 9*b* and 9*c*) which are stretched over and opposite to the connections 23 (23*a*, 23*b*, 23*c*, 23*d*, 23*e* and 2*f*) formed by the respective segment anodes 5 (5*a*, 5*b*, 5*c*, 5*d*, 5*e*, 5*f* and 5*g*).

The fluorescent display tube according to the eighth embodiment of the present invention shown in FIGS. 14 and 15 has, in each pattern display section 4, an integral shielding film 17 which is provided on the upper surface of the base plate 1 opposite to the segment anodes 5 (5*a*, 5*b*, 5*c*, 5*d*, 5*e*, 5*f* and 5*g*), which constitute each pattern dispaly section 4, with the insulating film 3 therebetween and is adapted to prevent influence of an external electric field penetrating through the gaps 22 (22*a*, 22*b*, 22*c*, 22*d*, 22*e* and 22*f*) formed between the respective adjacent ones of the segment anodes 5 (5*a*, 5*b*, 5*c*, 5*d*, 5*e*, 5*f* and 5*g*) and through the gaps 15 formed between each of the segment anodes 5 (5*a*, 5*b*, 5*c*, 5*d*, 5*e*, 5*f* and 5*g*) and each of the electrification preventive layers 14 (14*a*, 14*b*, and 14*c*). The shielding film 17 has a wide portion at the end of the wiring film 2*b* for the electrification preventive layer and is formed integrally therewith, and is connected to the terminal lead-in wire 8*c* through the wiring film 2*b*.

As mentioned above, the fluorescent tube according to the eighth embodiment of the present invention is provided with the shielding film 17 and therefore can not be influenced by an external electric field from under the bottom surface of the base plate 1 because of the shielding film 17 in addition to the electrification preventive layers 14, and as a result can obtain a very clear fluorescent display; whereas the fluorescent display tube according to the seventh embodiment of the present invention shown in FIGS. 11, 12 and 13 has the possibility of being influenced by an external strong electric field positioned in the vicinity in the bottom surface of the base plate 1 through the gaps 22 and 15 and thereby becoming unable to achieve a normal fluorescent display.

In the above-mentioned various embodiments of the present invention, each of a plurality of wiring films 2 is shown as connected within the casing 12, formed of the base plate 1 and the cover plate 11 air-tightly joined with each other, to each corresponding terminal lead-in wire 8. However, the arrangement of the connection is not limited to the above-mentioned. For instance, the wiring films 2 coated on the base 1 may be extended to the outside of the casing 12 through the seal portion 13. Of course, other arrangements are possible.

In the above-mentioned various embodiments of the present invention, each of the multi-column pattern display sections 4 is shown as having only a $\theta$-shaped pattern adapted to selectively display a figure from among the figures 0 to 9. However, the pattern is not limited to the above-mentioned. For instance, the display section may have various patterns adapted to display various figures, characters, symbols, etc. Furthermore, a suitable combination of various figures, characters, symbols, etc. different in columns may be applied.

In the above-mentioned various embodiments of the present invention, three cathodes 9 (9*a*, 9*b* and 9*c*) are shown as being provided. In addition, all these cathodes 9*a*, 9*b* and 9*c* are shown as being stretched over and opposite to any of the connections 23 (23*a*, 23*b*, 23*c*, 23*d*, 23*e* and 23*f*) of the respective segment anodes 5. However, the positions of the cathodes 9 are not limited to the above-mentioned. For instance, cathodes which are stretched over and opposite to the connections and cathodes which are not stretched opposite to the connections may be suitable combined. Of course, other various arrangements are possible.

As mentioned above, the fluorescent display tube according to the present invention is provided with the electrification preventive layers disposed in the vicinity of and flush with a plurality of segment anodes constituting each pattern display section, and the cathodes opposite to each of the corresponding connections formed by the respective segment anodes constituting each pattern display section, and is in the form of a diode suitable for use with a drive circuit of the static drive system; and therefore has the following various characteristics and excellent effects;

1. The fluorescent display tube according to the present invention is in the form of a diode with no mesh-shaped control grid in front of the pattern display section, and therefore is low in power consumption and can obtain a very clear and legible fluorescent display.

2. The fluorescent display tube according to the present invention has the terminal lead-in wires connected to the corresponding segment anodes, and therefore is suitable for being actuated by a drive circuit of the static drive system which does not produce any noise sources for an electronic equipment such as a clock radio.

3. The fluorescent display tube according to the present invention is provided with the electrification preventive layers on the upper surface of the base plate and is provided with cathodes stretching over and opposite to the connections of the respective segment anodes; and therefore has little portions to be electrified around each segment anode and is little influenced by an external electric field even when it is approached by a strong external electric field of static electricity or the like or even when it is approached by various electronic equipement such as radios and televisions or is incorporated therein and is therefore placed in the vicinity of a strong external electric field. Thus the fluorescent display tube according to the present invention can obtain a very clear display without uneven luminescence, lack of luminescence, ect. of the fluorescent material layers, which are disadvantages of the conventional diode-type fluorescent display tube with no mesh-control electrode.

4. The fluorescent display tube according to the present invention is additionally provided with shielding films for preventing influence of an external electric field from under the base plate. Thus the influence of an external field is further decreased. Therefore the display tube of the present invention can be effectively applied to a small-sized portable electronic desk calculator with a plastic casing liable to create static electricity, or to acoustic and image-displaying electronic equipment such as radios and televisions, or to a digital fluorescent display of an electronic clock incorporated in small-sized electronic equipment in which an electric field has an especially great influence on matter therein.

5. The fluorescent display tube according to the present invention is of a diode simple in construction without provision of a complicated, awkward mesh-shaped control electrode. In addition, the electrification preventive layer for use in the present invention can be installed in the display tube without any additional manufacturing process; for instance, can be installed simultaneously with the segment anode in the same coating process using the same material as that of the segment anode. Thus the fluorescent display tube according to the present invention can be made high in quality, easy to produce and inexpensive.

What is claimed is:

1. A multi-column fluorescent display tube comprising:

an insulating base plate, a light transparent insulating cover plate joined to the base plate at a seal portion in air-tight fashion in order to maintain a vacuum condition therebetween, a first wiring film disposed on the base plate, a filament support supported by the base plate, a second wiring film disposed on the base plate, an insulating film disposed on the base plate to insulate the first and second wiring films and portions thereof, a plurality of segment anodes forming a pattern display supported by the insulating film and connected to the first wiring film, a plurality of fluorescent material layers disposed on the plurality of segment anodes, a cathode disposed between the cover plate and the plurality of fluorescent material layers and connected to the filament support, an electrification preventive layer connected to the second wiring film and supported by the insulating film and disposed adjacent to the plurality of segment anodes to prevent electrification due to the collision of electrons emitted from the cathode, a plurality of first lead-in wires passing through the seal portion and connected to the first wiring film, a second lead-in wire passing through the seal portion and connected to the cathode, a third lead-wire passing through the seal portion and connected to the second wiring film, means for applying to the electrification preventive layer a bias voltage having a value between the anode voltage and the average of the cathode voltage and the anode voltage, means for applying a DC voltge across the cathode and selected ones of the plurality of segment anodes.

2. A multi-column fluorescent tube in accordance with claim 1 wherein the electrification preventive layer comprises a plurality of electrification preventive layers.

3. A multi-column fluorescent tube in accordance with claim 1 wherein the first film comprises a wiring film with expanded portions, the expanded portions of the first wiring film functioning to shield the gaps formed between the segment anodes and the electrification preventive layer.

4. A multi-column fluorescent tube in accordance with claim 1 wherein the second wiring film comprises a wiring film with expanded portions, the expanded portions of the second wiring film functioning to shield the gaps formed between the segment anodes and the electrification preventive layer.

5. A multi-column fluorescent tube in accordance with claim 1 further comprising high resistance films disposed on the insulating film for providing a high resistance of 1 MΩ to 100,000 MΩ between each segment anode and the electrification preventive layer.

6. A multi-column fluorescent tube in accordance with claim 1 further comprising a conductive shielding film disposed between the base plate and the first and second wiring films to prevent the influence of an external electric field and a second insulating film disposed between the conductive shielding film and the first and second wiring films.

7. A multi-column fluorescent tube in accordance with claim 1 wherein the cathode comprises a plurality of cathodes.

* * * * *